US007088300B2

(12) United States Patent
Fisher

(10) Patent No.: US 7,088,300 B2
(45) Date of Patent: Aug. 8, 2006

(54) VIVALDI ANTENNA

(75) Inventor: James Joseph Fisher, Winchester (GB)

(73) Assignee: Roke Manor Research Limited, Romsey (GB)

( * ) Notice: Subject to any disclaimer, the term of this patent is extended or adjusted under 35 U.S.C. 154(b) by 0 days.

(21) Appl. No.: 10/487,429

(22) PCT Filed: Aug. 22, 2002

(86) PCT No.: PCT/EP02/09474

§ 371 (c)(1),
(2), (4) Date: Aug. 18, 2004

(87) PCT Pub. No.: WO03/019716

PCT Pub. Date: Mar. 6, 2003

(65) Prior Publication Data

US 2005/0012672 A1 Jan. 20, 2005

(30) Foreign Application Priority Data

Aug. 24, 2001 (GB) ..... 0120615.0

(51) Int. Cl.
*H01Q 13/10* (2006.01)

(52) U.S. Cl. ..... 343/767; 343/770

(58) Field of Classification Search ..... 343/767, 343/873, 700 MS
See application file for complete search history.

(56) References Cited

U.S. PATENT DOCUMENTS 4,782,346 A * 11/1988 Sharma ..... 343/795
5,748,153 A * 5/1998 McKinzie et al. ..... 343/767
6,008,770 A * 12/1999 Sugawara ..... 343/767

FOREIGN PATENT DOCUMENTS

JP 11-284431 A 10/1999
JP 11-330846 A 11/1999
JP 2000-196344 A 7/2000

OTHER PUBLICATIONS

Kotthaus et al; "Investigation of Planar Antennas For Submillimeter Receivers", IEEE Transactions on Microwave Theory and Techniques, IEEE Inc. New York, US, vol. 37, No. 2, Feb. 1, 1989.
Acharya et al; "Tapered Slotline Antennas Antennas At 802 GHZ", IEEE Transactions on Microwave Theory and Techniques, IEEE Inc., New York, US, vol. 41, No. 10; Oct. 1, 1993.
Langley et al; "Balanced antipodal Vivaldi antenna for wide bandwidth phased arrays"; IEE Proceedings: Microwaves, Antennas and Propagation, IEE, Stevenage, Herts, GB, vol. 143, No. 2; Apr. 18, 1996.
Yngvesson, K. S., et al., The Tapered Slot Antenna—a New Integrated Element Formillimeter—Wave Applications, Microwave Theory and Techniques, Feb. 1989, pp. 365-374, vol. 37, Iss. 2.
European Search Report dated Jan. 22, 2005 (one (1) page).

* cited by examiner

*Primary Examiner*—Shih-Chao Chen
(74) *Attorney, Agent, or Firm*—Crowell & Moring LLP

(57) ABSTRACT

A directional, wideband, planar antenna arrangement is a class of Vivaldi aerial constructed as a plurality of conductive layers disposed on at least one substrate layer. The conductive layers are arranged to form a flared notch, which widens from a closed end to an open end, and is arranged to conform to a hybrid curve. The hybrid curve comprises a plurality of self-similar curve sections, and, as the flare widens, each successive curve section is scaled up by a scaling factor and joined at its wider end with a neighboring curve section. The hybrid flared notch can also be implemented in antipodal and balanced antipodal Vivaldi aerials.

15 Claims, 8 Drawing Sheets

VIVALDI ANTENNA

BACKGROUND OF THE INVENTION

The present invention relates to improvements in antennas. In particular the present invention relates to broadband antenna of the Vivaldi, notch or tapered slot antenna family.

The Vivaldi antenna element was proposed by Gibson in 1979, (P. J. Gibson, *The Vivaldi Aerial*, in Proc. 9$^{th}$ European Microwave Conference, UK, June 1979, pp. 101–105). The original Vivaldi antennas were tapered notch antennas having notches which open in an exponential flare shape. They were constructed by conventional microwave lithographic thin film techniques on substrates having a high dielectric constant, for example, alumina. Gibson's work has subsequently developed to include high gain Vivaldi antennas constructed on ceramic substrates other than alumina which have high dielectric constants and on substrates having low dielectric constant, for example, plastics. Copper-clad plastics (cuclad), for example PTFE, RT/duroid (having a variety of values, typically $\varepsilon_r$=2.2 or 2.94) or Kapton ($\varepsilon_r$=3.5), are now conventionally used when ease of manufacture, surface adhesion and price are paramount. Alternatively conductive layers can be formed from other good conductors including gold and gold-plated copper.

The exponential flare shape was originally adopted to address a requirement for a constant beamwidth antenna which could cover the microwave frequency range between 2 GHz and 20 GHz. As Gibson explains in his paper, the shape taken by the edge of the tapered slot must be completely specified in terms of dimensionless normalised wavelength units for the beamwidth to be held constant. Exponential curves are good candidates for shapes specified in this way.

Approximations to constant beamwidth antennas can also be constructed using alternative types of curves in place of exponential curves; these alternatives include sinusoidal, parabolic, hyperbolic and polynomial curves. The edges of the slot can also be formed as straight lines in which case the antenna can also be called a longitudinal (or linear) tapered slot antenna (LTSA).

Any conventional tapered slot antenna is constructed from a thin conductive layer disposed by lithographic thin film techniques on a substrate. A slot, open at one end, (also known as a notch) is formed in the conductive layer and the gap between the sides of the slot widens from a minimum at the closed end of the slot, also known as a "stub", to a maximum at the open end. In conventional Vivaldi antennas, the gap is mirror-symmetrical about an axis through the centre of the slot and each side of the conductive layer flares according to a predetermined exponential formula. The flared slot is an effective radiating element.

In operation, the antenna radiates preferentially from the open end of the notch in a direction away from the notch and along the axis of symmetry. The antenna may thus be classed as an endfire antenna.

Each region of conductive layer having a flare shaped edge will henceforth be referred to as a wing of the antenna due to the appearance of the conductive layer. It has been found effective to dispose two pairs of mirror-symmetrical wings on a thin substrate layer: one pair on either planar surface of the substrate layer. The pairs are preferably identical and the notch formed by one pair is preferably disposed parallel to the notch formed by the other pair.

The closed end of the slot line may be fed by any one of a variety of transmission lines including microstrip lines, striplines, fin-lines (as in waveguides) and probes. A microstrip transmission line generally comprises a track of conductor (usually copper) on an insulating substrate. On the reverse side of the substrate there is formed a ground plane (or "backplane") of conductor which acts as the return conductor.

Certain arrangements of tapered slot antenna can be fed from two parallel strips of conductor on either surface of a flattened substrate in a transmission line formation know as a twinline feed. Variations on the Vivaldi antenna structure for which a twinline feed is appropriate include the (unbalanced) antipodal Vivaldi antenna and the balanced antipodal Vivaldi antenna.

In twinline fed antennas, the conductive wing regions are each arranged to have an inner edge and an outer edge. In the same way as the edge of the slot in a conventional Vivaldi antenna follows a flared curve, the inner edge of the conductive wing regions can be formed to conform to a similar flared curve. In contrast to the indefinite extent of the conductive layer away from the slot in a conventional Vivaldi antenna arrangement, a second outer edge can define the outer extent of each conductive wing. The outer edge too can be formed to follow a broader flared curve.

The (unbalanced) antipodal Vivaldi antenna was developed by Gazit in 1988 (E. Gazit, *Improved design of the Vivaldi antenna*, in IEE Proc., Vol. 135, Pt. H, No. 2, April 1988, pp 89–92) is constructed on a single sheet of microwave dielectric substrate and fed from a twinline. The conductor strip on one side of the twinline feeds a first wing on a first side of the substrate and the other conductor strip feeds a second wing on the second side of the substrate. The first and second wings are arranged so that, from a point of view at right angles to the plane of the substrate, there is a flare shaped slot.

The balanced antipodal Vivaldi antenna, developed by J. D. S. Langley, P. S. Hall and P. Newham in 1996, is constructed on a sandwich of at least two sheets of dielectric substrate and fed from a balanced twinline.

A balanced antipodal Vivaldi antenna can be constructed from a first wing on one side of a first sheet of dielectric substrate and a second wing on the other side of the first sheet. A second sheet of dielectric substrate is provided with a third wing on an outer side. The first sheet and second sheet are sandwiched together so that the first and third wings are outermost and so that a sheet of dielectric substrate is interposed between the first wing and the second wing and between the third wing and the second wing. The first and third wings are arranged to flare in a first curved shape. The second wing is arranged to flare in a second curved shape—the second curved shape being the mirror image of the first curved shape. When viewed at right angles to the plane of the substrates, the first and third wings on one side and the second wing on the other side form a flare shaped slot.

In theory, a Vivaldi antenna should radiate radio frequency electromagnetic waves at a given wavelength when the width of the widening slot (at right angles to the axis of symmetry) is approximately equal to half the wavelength. The performance of physical implementations of conventional antennas is degraded by a number of complicating factors. In particular, the edge of the flared slot becomes linear at either extreme of a limited range of frequencies.

It has been established experimentally that the conventional exponential flare shaped Vivaldi antenna has poor performance over ultra-wide bandwidths. The crisp radiation properties of the exponential flare break down both as operating frequency increases above the bounds of a characteristic range and as the frequency decreases below the bounds.

It has been noted that antennas constructed to the same basic exponential curve have a most reliable frequency range which depends upon the characteristic length scale of the antenna. To give concrete examples, an antenna having a maximum flare width of two centimeters has a relatively reliable performance over the frequency range 15–40 GHz while a larger antenna with a maximum flare width of the order of ten centimeters has a better performance at lower frequencies, between 1 and 10 GHz. In the example, the dielectric constant of the substrate used in both antennas was 2.94.

A perfect antenna would radiate electromagnetic waves of a given frequency at a point along the centre line of the slot for which the width of the widening slot is equal to half the wavelength corresponding to the given frequency. In the real world, antennas do not function so straightforwardly. As the given frequency increases, the point of radiation moves towards the closed end of the slot. As the slot narrows, the gradient of the exponential curve of the slot edge decreases in the direction of the closed end and becomes too shallow to radiate effectively.

On the other hand, as the given frequency decreases, the point of radiation moves towards the open end of the slot. As the slot becomes wider the gradient of the exponential curve increases and becomes too steep to radiate effectively.

It is therefore an object of the invention to obviate or at least mitigate the aforementioned problems.

SUMMARY OF THE INVENTION

In accordance with one aspect of the present invention, there is provided a planar antenna arrangement for emitting electromagnetic waves in an endfire direction, the antenna arrangement comprising: a plurality of conductive layers; and at least one substrate layer, wherein the conductive layers are arranged to form a notch, the notch having a closed end and an open end and the endfire direction being the direction from the closed end to the open end, wherein each conductive layer comprises at least one conductive wing, each conductive wing bounding the notch at an inner edge, and wherein the inner edge of each conductive wing is arranged to conform to a hybrid curve, the hybrid curve comprising a plurality of curve sections.

Advantageously, the hybrid curve is monotonically increasing in the endfire direction.

Each of the curve sections may be a section of an exponential curve.

Preferably, the curve sections are self-similar. Every self-similar curve section may conform to a corresponding curve formula, the curve formula corresponding to adjacent curve sections differing by a fundamental scaling factor; and the self-similar curve sections may increase in scale as the notch widens towards the open end, whereby each curve section disposed closer to the open end of the notch is scaled up by the fundamental scaling factor from each adjacent curve section disposed closer to the closed end of the notch.

It is preferred that the hybrid curve comprises a first curve section and a second curve section, one end of the first curve section being disposed at the closed end of the notch, the remaining end of the first curve section meeting with one end of the second curve section at a first node and the second curve section having the same curved form as the first curve section.

The hybrid curve may comprise a further curve section, said further curve section meeting the remaining end of the second curve section at a further node and having the same curved form as the first and second curve sections.

The hybrid curve may comprise yet further curve sections, the or each of said further curve sections meeting a remaining end of each respective preceding curve section at yet further nodes and having the same curved form as the first and second curve sections.

Advantageously, the or each of said nodes may be blended to eliminate discontinuities.

Each successive curve section is preferably longer in the endfire direction than each respective preceding curve section.

The conductive layers may advantageously be fed by a microstrip transmission line.

Alternatively the conductive layers may be fed by a twinline. The antenna may be an antipodal antenna. The antenna may also be a balanced antipodal antenna. In either case, the trailing edge of each conductive wing is advantageously arranged to conform to a further hybrid curve.

The present invention addresses problems associated with the exponential flare shape used in known Vivaldi antennas by adopting a curved shape which conforms to a hybrid curve. When the hybrid curve is constructed from a succession of self-similar curve sections flare shape can be said to be fractalized.

Other objects, advantages and novel features of the present invention will become apparent from the following detailed description of the invention when considered in conjunction with the accompanying drawings.

DETAILED DESCRIPTION OF THE INVENTION

Figure 1:
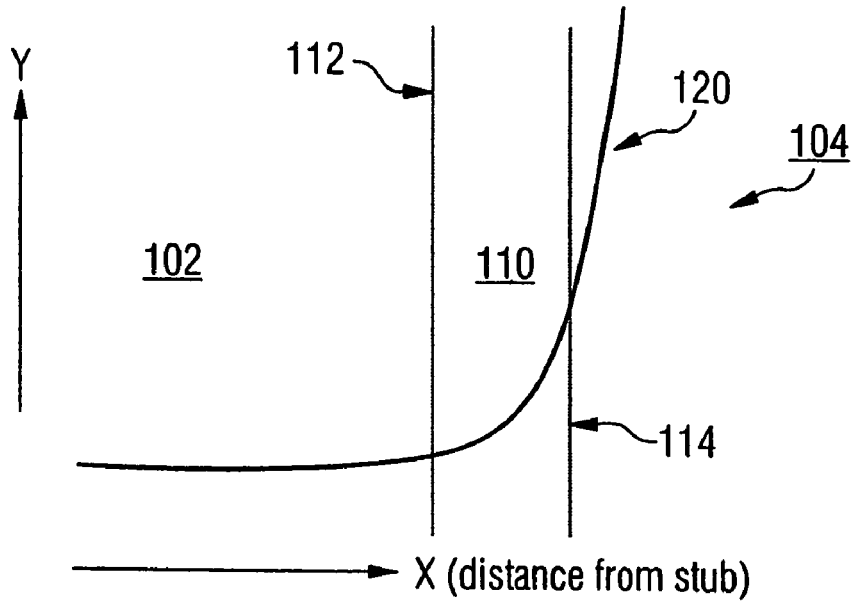
FIG 1 (PRIOR ART)
FIG. 1 is a diagram of an exponential curve suitable for a conventional Vivaldi antenna.

FIG. 1 is a diagram of an exponential curve 120 and can be used to illustrate how a conventional Vivaldi antenna operates over a range of frequencies. A conventional Vivaldi antenna includes a conducting layer comprising two symmetrical conducting wings. Each of the conducting wings has an inner edge which is cut away along an exponential curve. A flared notch is thereby formed between the two conducting wings. Radio frequency waves at a given frequency radiate from a corresponding point along the axis of symmetry, X. The corresponding point is the point at which the width of the flared notch is equal to half the wavelength.

In principle, increasingly higher frequencies are radiated from points increasingly closer to the left of the illustrated exponential curve. Effective radiation is limited at both a lower and an upper frequency boundary, 112,114.

As the given frequency increases, the corresponding point of radiation moves towards the closed end of the flared notch. From points to the left of the lower boundary 112, the flared notch narrows so much that the gradient of the exponential curve 120 becomes too shallow to radiate effectively.

As the given frequency decreases, the corresponding point of radiation moves towards the open end of the flared notch. For points to the right of a second boundary 114, the notch becomes so wide that the gradient of the exponential curve becomes too steep to allow effective radiation.

An appropriate feeding mechanism for certain antenna in accordance with the present invention would be a microstrip transmission line. As may be seen in FIG. 2, a microstrip transmission line generally comprises a track of conductor 220 (usually copper) on an insulating substrate 240. On the reverse side of the substrate 240 there is formed a ground plane 230 (or "backplane") of conductor which acts as the return conductor.

Figure 3A:
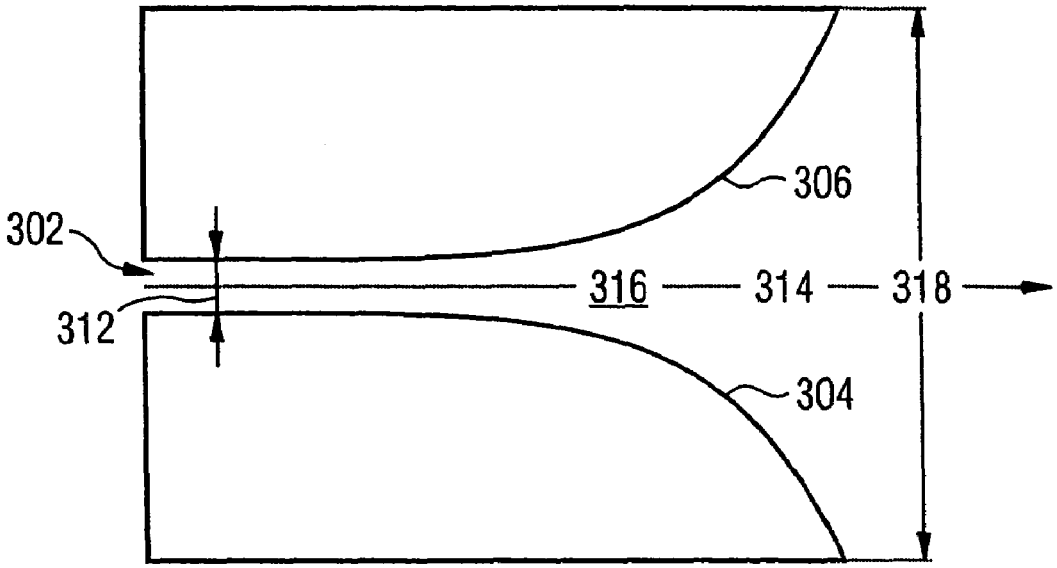
FIG 3A (PRIOR ART)
FIG. 3A shows an arrangement of conductive wings suitable for use in a conventional Vivaldi antenna.
Figure 3B:
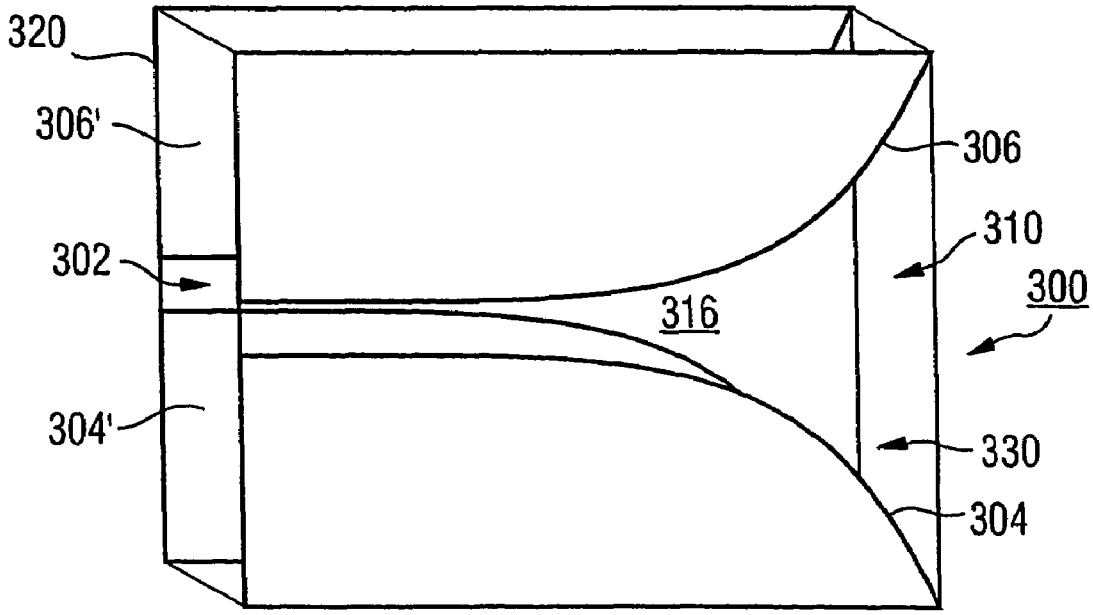
FIG 3B (PRIOR ART)
FIG. 3B shows a conventional Vivaldi antenna arrangement.
Figure 4:
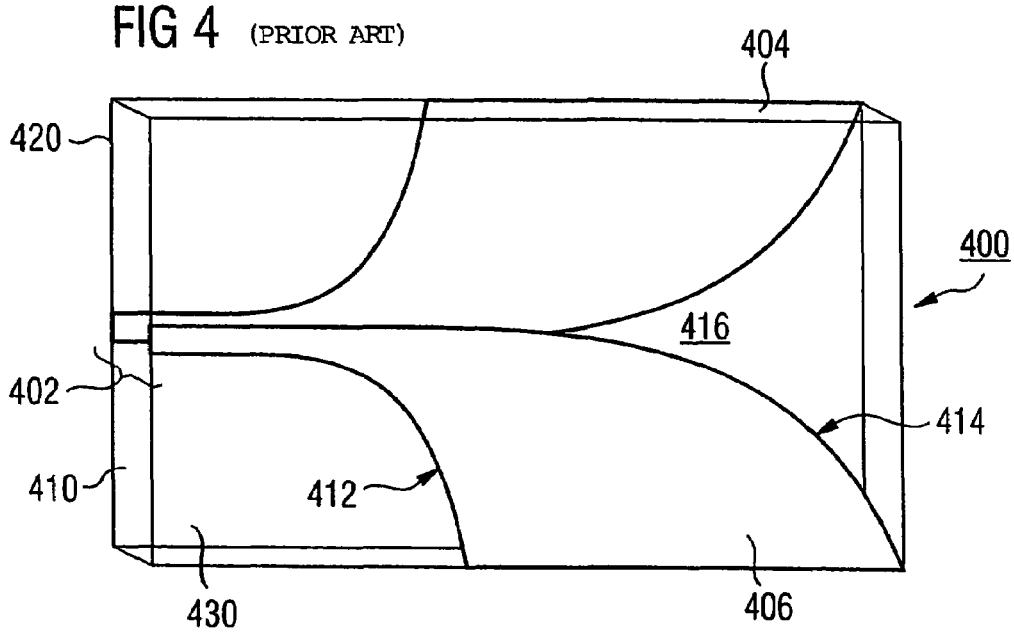
FIG 4 (PRIOR ART)
FIG. 4 shows a conventional unbalanced antipodal Vivaldi antenna arrangement.
Figure 5:
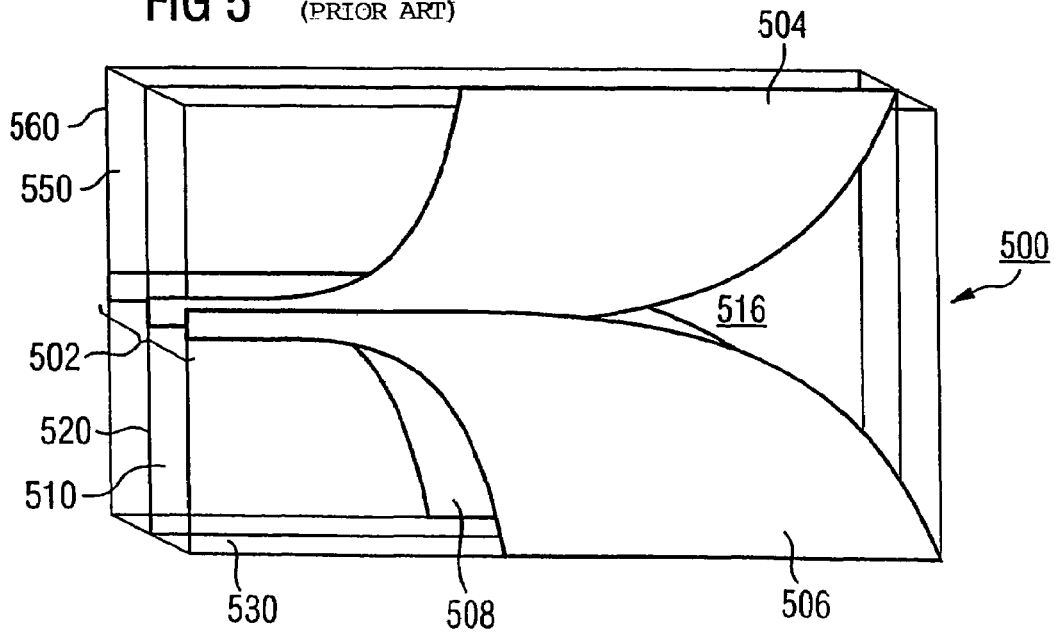
FIG 5 (PRIOR ART)
FIG. 5 shows a conventional balanced antipodal Vivaldi antenna arrangement.

FIGS. 3A to 5 show arrangements of different conductive wings suitable for use in a conventional antennas. FIG. 3B shows a conventional Vivaldi antenna arrangement. FIGS. 4 and 5 show conventional unbalanced and balanced antipodal Vivaldi antenna arrangements respectively.

FIG. 3A shows the pattern in which one conductive layer is disposed upon a substrate in the construction of conventional Vivaldi aerial 300. A notch 316 is formed in the conductive layer and the gap between the sides of the slot (the two 'wings') widens from a minimum 312 at the closed end of the notch to a maximum 318 at the open end. The gap is mirror-symmetrical about an axis 314 through the centre of the notch 316 and each side 304,306 of the conductive layer flares according to a predetermined exponential formula.

As may be seen from FIG. 3B, a Vivaldi aerial may be constructed from two pairs of mirror-symmetrical wings 304,306,304',306' on a thin substrate layer 310: one pair on either planar surface 320,330 of the substrate layer 310. The pairs 304,306,304',306' are preferably identical and the notch 316 formed by one pair is preferably disposed parallel to the notch 316' formed by the other pair.

Figure 2:
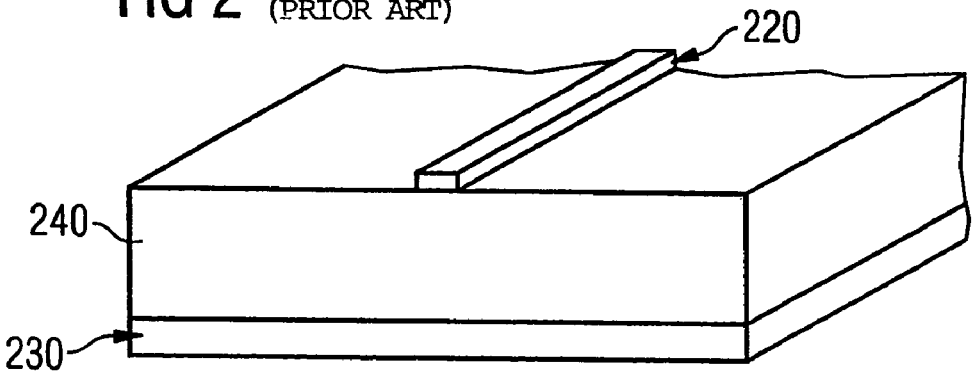
FIG 2 (PRIOR ART)
FIG. 2 shows a conventional microstrip transmission line.

The antennas 300 in FIG. 3 are fed by a transmission line, such as the microstrip line illustrated in FIG. 2, at the closed end of the notch 302.

As discussed above, the class of Vivaldi antennas includes antipodal Vivaldi antenna, both unbalanced and balanced. Examples of antipodal Vivaldi antennas are shown in FIGS. 4 and 5.

In antipodal Vivaldi antennas, the conductive wing regions 404,406,504,506,508 are each arranged to have an inner edge 414 and an outer edge 412. Just as the edge of each wing 304,306 in FIG. 3A follows a flared curve, the inner edge 414 of the conductive wing regions of FIGS. 4 and 5 can be formed to follow a similar flared curve. In contrast to the indefinite extent of the conductive layer away from the slot in the conventional Vivaldi antenna arrangement 300, an outer edge 412 can define the outer extent of each conductive wing. The outer edge 412 too can be formed to follow a broader flared curve.

As shown in FIG. 4, the unbalanced antipodal Vivaldi antenna 400 is constructed on a single sheet of microwave dielectric substrate 410 and fed from a twinline 402. The conductor strip on one side of the twinline feeds a first wing 406 on a first side 430 of the substrate and the other conductor strip feeds a second wing 404 on the second side 420 of the substrate. The first and second wings 404,406 are arranged so that, from a point of view at right angles to the plane of the substrate 410, there is a flare shaped slot 416.

In a similar manner the balanced antipodal Vivaldi antenna 500 shown in FIG. 5 is constructed on a sandwich of at least two sheets of dielectric substrate 510, 550 and fed from a balanced twinline 502.

A balanced antipodal Vivaldi antenna 500 can be constructed from a first wing 506 on one side 530 of a first sheet of dielectric substrate 510 and a second wing 504 on the other side 520 of the first sheet 510. A second sheet of dielectric substrate 550 is provided with a third wing 508 on an outer side 560. The first sheet 510 and second sheet 550 are sandwiched together so that the first and third wings 506,508 are outermost and so that a sheet of dielectric substrate is interposed between the first wing 506 and the second wing 504 and between the third wing 508 and the second wing 504. The first and third wings 506,508 are arranged to flare in a first curved shape. The second wing 504 is arranged to flare in a second curved shape—the second curved shape being the mirror image of the first curved shape. When viewed at right angles to the plane of the substrates, the first and third wings on one side and the second wing on the other side form a flare shaped slot 516.

The range over which conventional Vivaldi antenna can operate is limited by the phenomena discussed in relation to FIG. 1. It has been found that by constructing the flare shaped notch to conform to a certain hybrid curve the range over which an antenna can operate can be vastly increased.

Figure 6A:
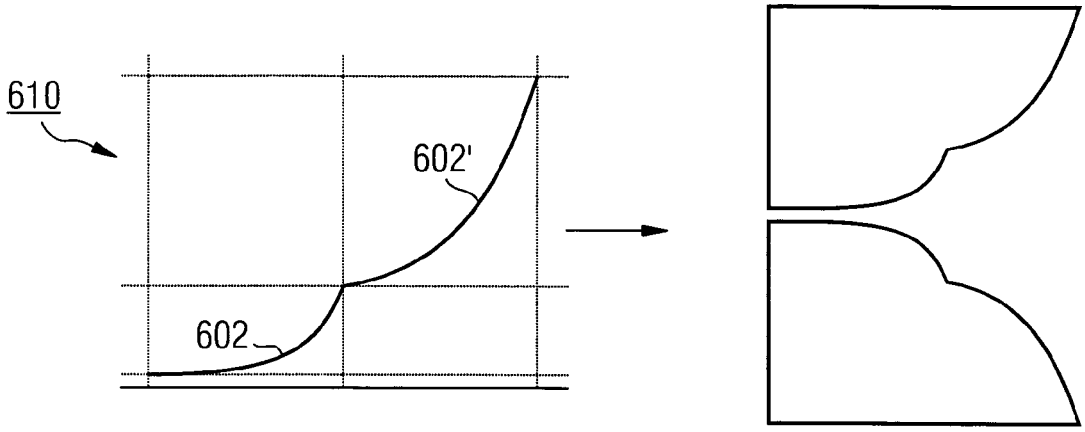
FIG. 6A shows an arrangement of conductive wings suitable for use in a Vivaldi antenna arrangement in accordance with the present invention.
Figure 6B:
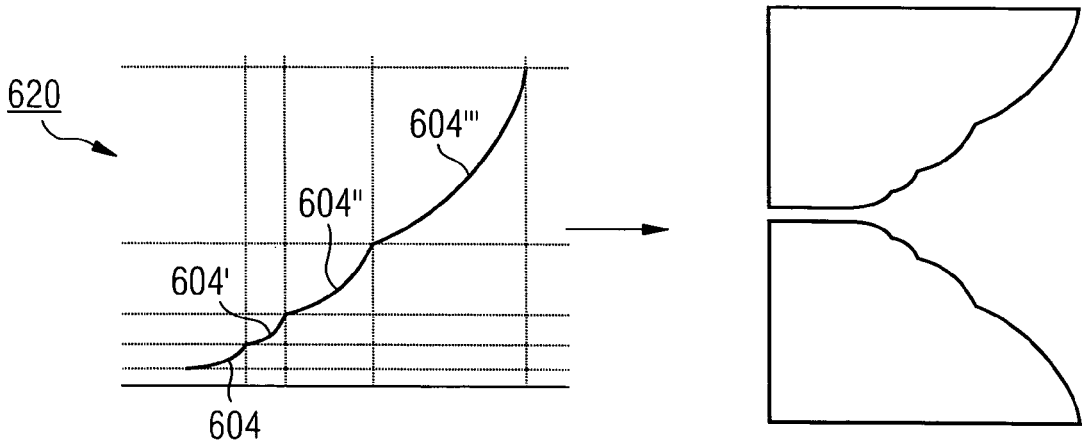
FIG. 6B shows an alternative arrangement of conductive wings suitable for use in a Vivaldi antenna arrangement in accordance with the present invention.

FIGS. 6 and 7 illustrate how such a hybrid curve should be constructed. As may be seen in FIGS. 6A and 6B, the curve is composed of two or more smaller curves. The smaller curves can belong to a variety of categories including exponential, sinusoidal, and parabolic. FIGS. 6A and 6B show versions of an antenna. In both cases the antenna is fed from a slot line. The curve in FIG. 6A is formed from a hybrid of two exponential curve sections 602,602'. Similarly, the curve in FIG. 6B is formed from a hybrid of four exponential curve sections 604,604',604", 604'''.

It will be noted from FIG. 6B that each successive curve section 604,604',604",604''' is similar to its neighbour but scaled by a scaling factor. In cases where curve sections are scaled versions of their neighbours it is appropriate to call the hybrid curve a fractal, or fractalized, curve and the individual curve sections may be termed self-similar.

The embodiments of such fractalized flare shapes described herein are example only, the numbers of curve sections in each hybrid curve, the form taken by each curve section, and the scaling factor will clearly be varied in accordance with the requirements of any particular implementation.

Figure 7A:
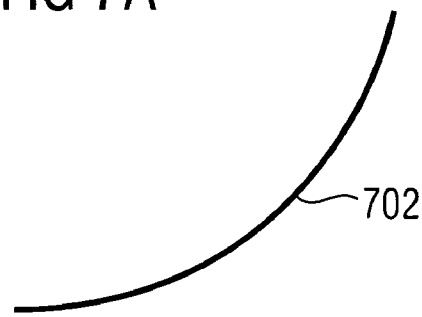
FIGS. 7A to 7E show examples of blended and unblended exponential curves which may define the edge curve of conductive wings in accordance with the present invention.
Figure 7B:
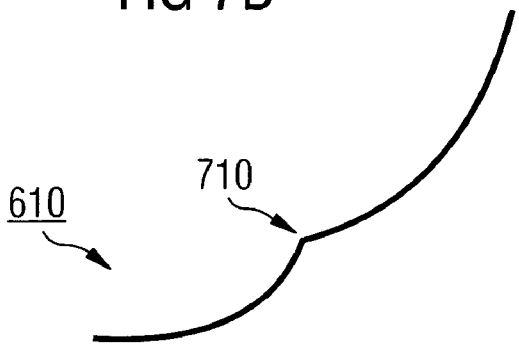
Figure 7C:
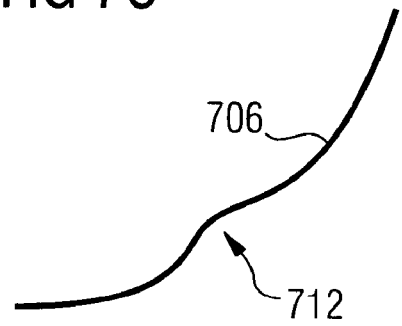
Figure 7D:
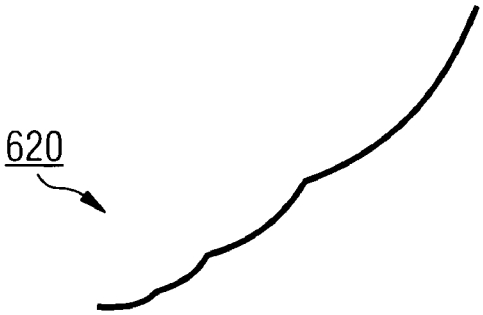

The same hybrid curves 610, 620 are shown at FIGS. 7B and 7D respectively. To overcome problems that may be associated with the sharp discontinuities (such as a null in the boresight gain pattern at specific frequencies) the curves that comprise hybrid curves may be blended to some degree. Examples of blended curves are shown at FIGS. 7A, 7C and 7E.

In FIG. 7C the hybrid curve 610 formed from two exponential curve sections is shown partially blended 706. This contrasts with a fully blended version 702 shown at FIG. 7A. The sharp discontinuity 710 is blended away to leave an inflection point 712.

Figure 7E:
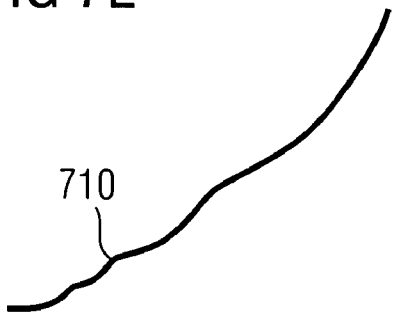

FIG. 7E shows a partially blended version 710 of the hybrid curve 620 in FIG. 7D. Again sharp discontinuities are avoided.

As will be appreciated the proposed improvements to the curved shapes of the inner sides of conductive wing regions apply equally to conventional Vivaldi antenna, unbalanced antipodal Vivaldi antenna and balanced antipodal Vivaldi antenna.

Figure 8:
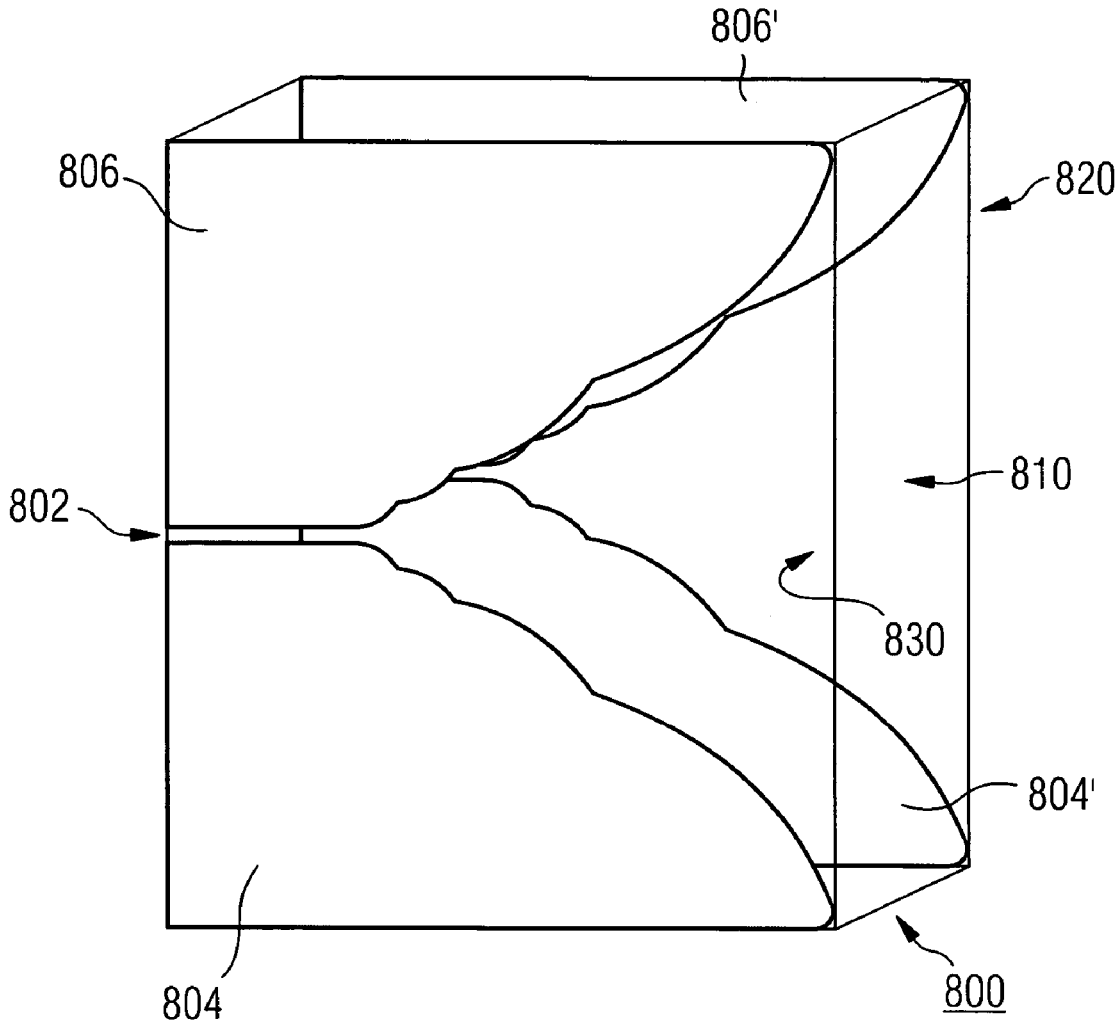
FIG. 8 shows a Vivaldi antenna arrangement in accordance with the invention.

FIG. 8 shows a Vivaldi antenna arrangement 800 in accordance with the present invention. The antenna is fed by a slot line 802 and is constructed from a single sheet of double sided copper clad dielectric substrate 810.

In this first embodiment of the present invention, the hybrid fractalized curve 620 constructed from four exponential curve sections is implemented on the inner edge of the wing regions 804,806, 804',806'.

Figure 9A:
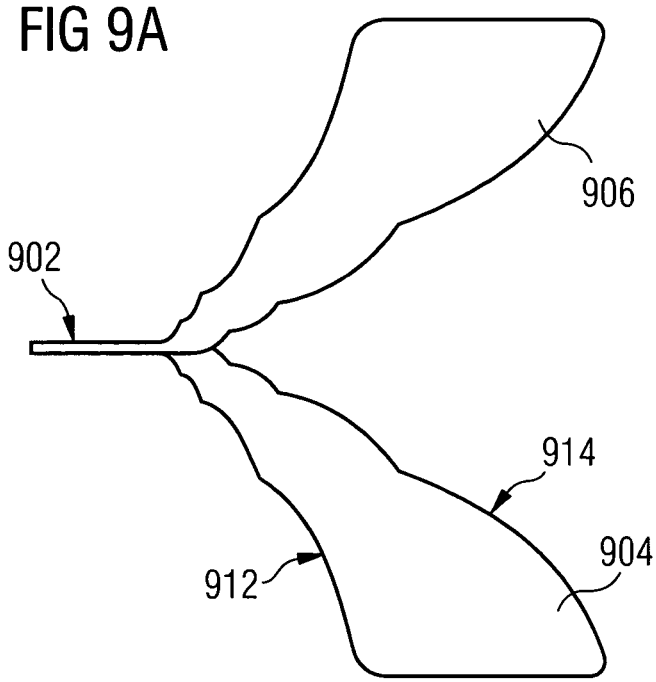
FIG. 9 shows an unbalanced antipodal Vivaldi antenna arrangement in accordance with the invention.
Figure 9B:
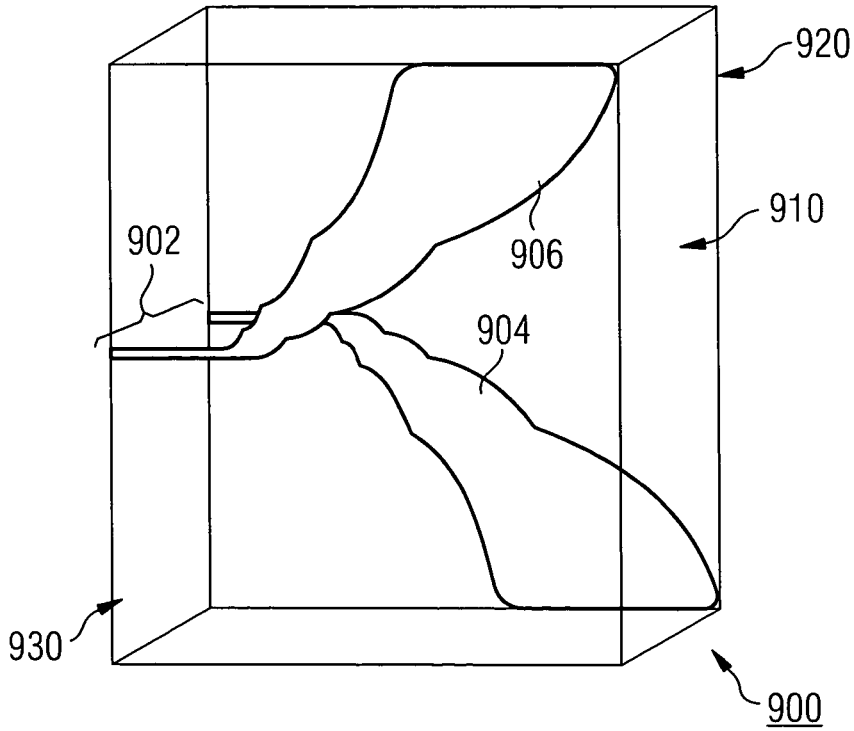

The antenna arrangement shown in FIG. 9 is also constructed from a single sheet 910 of double sided copper clad dielectric substrate. On this occasion the antenna is fed by a twinline 902.

FIG. 9 shows a second embodiment of the present invention in which the hybrid fractalized curve 620 is applied to the inner edges 914 of the conductive wing regions 904,906 in an unbalanced antipodal configuration 900.

It is noted that the trailing edges 912 of the conductive wing regions are also formed in accordance with a hybrid fractalized curve. Furthermore the series of curve sections making up the fractalized trailing edge 912 may be blended as described in FIGS. 7A to 7E. The use of hybrid curves on the trailing edge 912 can help reduce low frequency return loss.

Figure 10:
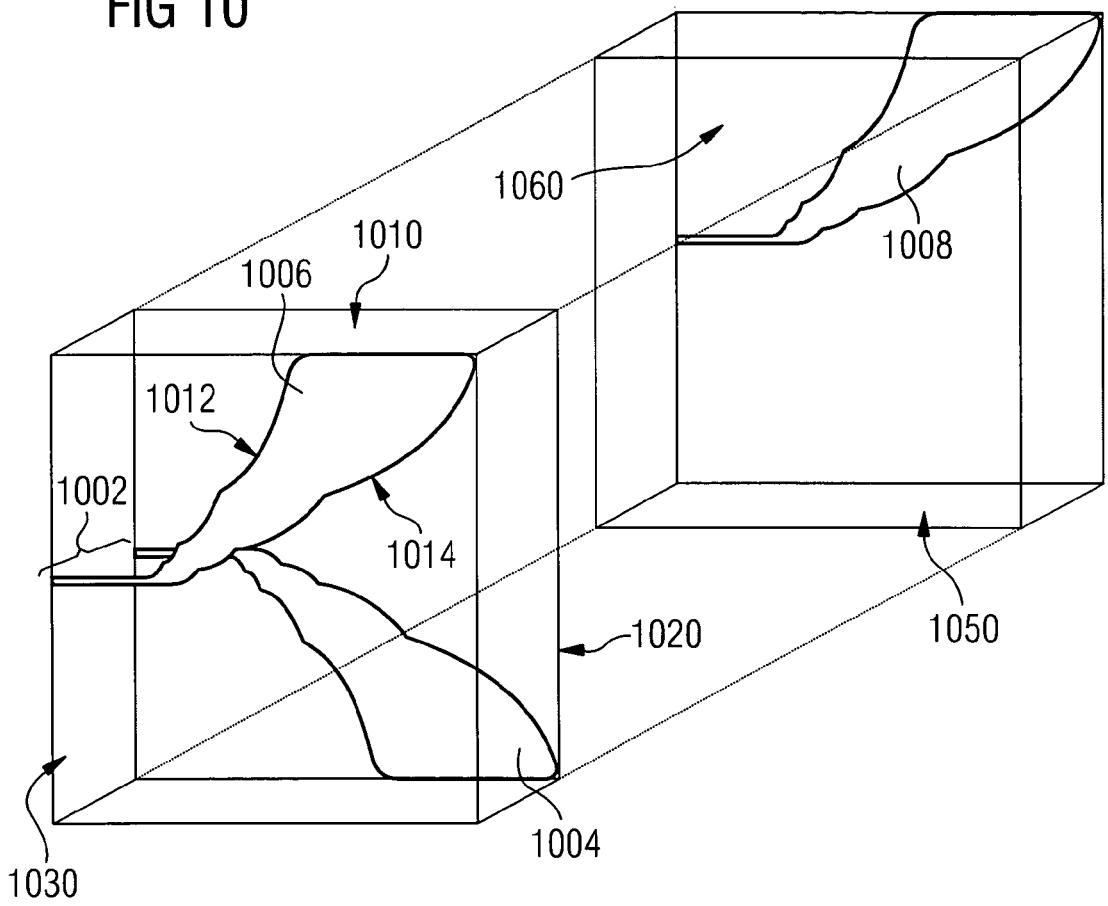
FIG. 10 shows a balanced antipodal Vivaldi antenna arrangement in accordance with the invention.

The balanced antipodal Vivaldi antenna shown in FIG. 10 is constructed from two sheets of double sided copper clad dielectric substrate 1030,1050 sandwiched together and is fed from a balanced twinline 1002.

FIG. 10 shows a third embodiment of the present invention in which the hybrid fractalized curve 620 is applied to the inner edges 1014 of the conductive wing regions 1004, 1006 in a balanced antipodal configuration 1000.

Again the trailing edges 1012 of the conductive wing regions 1004,1006 are also formed in accordance with a hybrid fractalized curve.

As will be understood antennas in accordance with the present invention may constructed from a conductor clad dielectric microwave substrate material just as conventional Vivaldi antennas are. The type of construction depends upon the type of feed to the antenna which in turn depends upon the particular class of antenna implemented.

The foregoing discussion considered the arrangement of a single antenna. It is however well known in the art to form arrays from a plurality of similar antennas. Furthermore it is known to provide antennas with identical endfire directions but rotated at an angle relative to one another about the endfire axis to allow for radiation having different polarisation. It will be understood that antennas in accordance with the present invention can be used as elements of an antenna array and in orthogonal pairs for dual-polarised functionality. The present invention is also considered applicable to arrays of dual-polarised antenna pairs.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A planar antenna arrangement for emitting electromagnetic waves in an endfire direction, the antenna arrangement comprising:

a plurality of conductive layers; and at least one substrate layer; wherein, the conductive layers are arranged to form a notch, the notch having a closed end and an open end and the endfire direction being the direction from the closed end to the open end;

each conductive layer comprises at least one conductive wing;

each conductive wing bounds the notch at an inner edge; and the inner edge of each conductive wing is arranged to conform to a hybrid curve, the hybrid curve comprising a plurality of directly adjacent curve sections.

2. An antenna arrangement according to claim 1, wherein the hybrid curve is monotonically increasing in the endfire direction.

3. An antenna arrangement according to claim 1, wherein each of the curve sections is a section of an exponential curve.

4. An antenna arrangement according to claim 1, wherein the curve sections are self-similar.

5. An antenna arrangement according to claim 4, wherein every self-similar curve section conforms to a corresponding curve formula, the curve formula corresponding to adjacent curve sections differing by a fundamental scaling factor; and wherein the self-similar curve sections increase in scale as the notch widens towards the open end, whereby each curve section disposed closer to the open end of the notch is scaled up by the fundamental scaling factor from each adjacent curve section disposed closer to the closed end of the notch.

6. An antenna arrangement according to claim 1, wherein the hybrid curve comprises a first curve section and a second curve section, one end of the first curve section being disposed at the closed end of the notch, the remaining end of the first curve section meeting with one end of the second curve section at a first node and the second curve section having the same curved form as the first curve section.

7. An antenna arrangement according to claim 6, wherein the hybrid curve comprises a further curve section, said further curve section meeting the remaining end of the second curve section at a further node and having the same curved form as the first and second curve sections.

8. An antenna arrangement according to claim 6, wherein the hybrid curve comprises yet further curve sections, the or each of said further curve sections meeting a remaining end of each respective preceding curve section at yet further nodes and having the same curved form as the first and second curve sections.

9. An antenna arrangement according to claim 6, wherein the or each of said nodes is blended to eliminate discontinuities.

10. An antenna arrangement according to claim 6, wherein each successive curve section is longer in the endfire direction than each respective preceding curve section.

11. An antenna arrangement according to claim 1, wherein the conductive layers are fed by a microstrip transmission line.

12. An antenna arrangement according to claim 1, wherein the conductive layers are fed by a twinline.

13. An antenna arrangement according to claim 12, wherein the antenna is an antipodal antenna.

14. An antenna arrangement according to claim 13, wherein the antenna is a balanced antipodal antenna.

15. An antenna arrangement according to claim 13, wherein the trailing edge of each conductive wing is arranged to conform to a further hybrid curve.

* * * * *